US011003139B2

(12) United States Patent
Gerber et al.

(10) Patent No.: US 11,003,139 B2
(45) Date of Patent: May 11, 2021

(54) MECHANISM FOR A WATCH MOVEMENT

(71) Applicant: Chanel Sarl, Geneva (CH)

(72) Inventors: Yves Gerber, Cernier (CH); Guilhem Watrelot, Villers-le-Lac (FR); Sebastien Mojon, La Chaux-de-Fonds (CH)

(73) Assignee: Chanel Sarl, Geneva (CH)

( * ) Notice: Subject to any disclaimer, the term of this patent is extended or adjusted under 35 U.S.C. 154(b) by 277 days.

(21) Appl. No.: 16/085,520

(22) PCT Filed: Mar. 15, 2017

(86) PCT No.: PCT/IB2017/051511
§ 371 (c)(1),
(2) Date: Sep. 14, 2018

(87) PCT Pub. No.: WO2017/158536
PCT Pub. Date: Sep. 21, 2017

(65) Prior Publication Data

US 2019/0332059 A1 Oct. 31, 2019

(30) Foreign Application Priority Data

Mar. 15, 2016 (CH) ..... 00350/16

(51) Int. Cl.
*G04B 19/20* (2006.01)
*G04B 19/06* (2006.01)
*G04B 19/08* (2006.01)

(52) U.S. Cl.
CPC ..... *G04B 19/202* (2013.01); *G04B 19/065* (2013.01); *G04B 19/082* (2013.01)

(58) Field of Classification Search
CPC .. G04B 19/202; G04B 19/065; G04B 19/082; G04B 19/20; G04B 19/06; G04B 19/08
See application file for complete search history.

(56) References Cited

U.S. PATENT DOCUMENTS 5,235,562 A 8/1993 Vaucher
5,784,342 A 7/1998 Genta
6,826,122 B2 * 11/2004 Zaugg ..... G04B 19/23 368/28

(Continued)

FOREIGN PATENT DOCUMENTS

CH 681761 A3 5/1993
CH 688068 A3 5/1997

(Continued)

OTHER PUBLICATIONS

International Search Report for PCT/IB2017/051511 dated Jul. 6, 2017, 2 pages.

(Continued)

*Primary Examiner* — Sean Kayes
(74) *Attorney, Agent, or Firm* — Blank Rome LLP

(57) ABSTRACT

Mechanism for a watch movement (1) comprising a cam (5), a rack (3) driven by the cam (5), a retrograde mobile (20) driven by said rack (3) and bearing a retrograde indicator (2) for displaying a first item of time information, the rack (3) and the retrograde mobile (20) being arranged in such a way as to rotate in the same direction. A jumping hour display ring is synchronized with the returns of the retrograde display.

12 Claims, 11 Drawing Sheets

(56) References Cited

U.S. PATENT DOCUMENTS

| | | | | |
|---|---|---|---|---|
| 7,974,156 | B2 | 7/2011 | Papi et al. | |
| 8,398,299 | B2 * | 3/2013 | Wiederrecht | G04B 19/082 368/132 |
| 8,937,850 | B2 * | 1/2015 | Mahler | G04B 19/02 368/38 |
| 8,953,418 | B2 * | 2/2015 | Crettex | G04B 19/02 368/80 |
| 8,982,677 | B2 | 3/2015 | Graf et al. | |
| 9,261,859 | B2 * | 2/2016 | Rochat | G04B 19/235 |
| 9,285,774 | B2 * | 3/2016 | Rochat | G04B 19/23 |
| 10,222,749 | B2 * | 3/2019 | Denden | G04B 19/044 |
| 2010/0027381 | A1 * | 2/2010 | Mahler | G04B 19/02 368/28 |
| 2011/0205854 | A1 * | 8/2011 | Wiederrecht | G04B 19/082 368/132 |
| 2013/0182543 | A1 * | 7/2013 | Crettex | G04B 19/02 368/220 |

FOREIGN PATENT DOCUMENTS

| | | | |
|---|---|---|---|
| CH | 691833 | A5 | 10/2001 |
| CH | 698132 | B1 | 5/2009 |
| CH | 701406 | A1 | 1/2011 |
| DE | 10200284 | C1 | 1/2003 |
| EP | 0788036 | A2 | 8/1997 |
| EP | 1134627 | A1 | 9/2001 |
| EP | 2010971 | A2 | 1/2009 |
| EP | 2595006 | A1 | 5/2013 |
| EP | 2615505 | A1 | 7/2013 |
| EP | 2778800 | A1 | 9/2014 |
| WO | WO-97/40424 | A1 | 10/1997 |

OTHER PUBLICATIONS

International Written Opinion for PCT/IB2017/051511 dated Sep. 21, 2017, 5 pages.

* cited by examiner

MECHANISM FOR A WATCH MOVEMENT

RELATED APPLICATIONS

This application is a national phase of PCT/IB2017/051511, filed on Mar. 15, 2017, which claims the benefit of Swiss Application No. 00350/16, filed on Mar. 15, 2016. The entire contents of these applications are hereby incorporated by reference.

TECHNICAL FIELD

The present invention relates to a mechanism for a watch movement with retrograde and jumping display.

PRIOR ART

Retrograde displays, namely displays in which a hand or a disk rotates in one direction over a given period and then snaps back almost instantaneously to the initial position by rotating quickly in the opposite direction at the end of this period, are known in horology. These retrograde displays are used, for example, to indicate minutes over a graduation from 1 to 60 covering a circular arc of under 360°. These retrograde displays make it possible to free up space on the dial for indicating other information. Furthermore, the rapid return of the minutes indicator every hour creates movement on the watch face.

Jumping displays, in which a time indicator jumps almost instantaneously from one value to another, are also known. These jumping displays are notably used for displaying the day-of-the-month in a window. They are also sometimes used to indicate other information, including indicating the current hour in a window. Within the present application, the expression "jumping display" covers both displays in which the jump is near-instantaneous and displays referred to as trailing displays in which this jump is not as rapid, although the moving-on of the display is nevertheless discontinuous.

It is an object of the present invention to create a watch movement that combines both a retrograde display and a jumping display.

Watches that combine a retrograde display and a jumping display are known per se. EP0950932B1 describes for example a watch comprising a minutes display over 180° and a jumping hours display on a disk. The hours disk is actuated by means of a snail cam.

CH691833 describes another example of a watch comprising a jumping hours display and a retrograde minutes display. A minutes rack has two toothed parts, one for transmitting the movement to the minutes display member and the other to be driven by a pinion with one missing tooth, this pinion being fixed to the hours wheel and driven at the rate of one revolution per hour. The instantaneous return of the rack corresponds to the movement of the last tooth of the rack at the site of the missing tooth of the pinion.

CH698132 relates to a watch with a jumping hours display and a retrograde minutes display, in which the hour jump of an hours disk and the return of the retrograde hand are both brought about by the one same cam acting on a link.

EP1134627B1 relates to a watch with a triple (minutes, hours, date) retrograde display, the hours display being a jumping display. The retrograde hours display is achieved by means of a rack moving in both directions.

WO9740424 relates to a watch comprising a retrograde minutes display over 180° and a jumping hours display borne by a disk and visible through a window.

EP0788036B1 relates to a watch with a retrograde minutes display and a jumping hours display on a disk. A lever is progressively lifted once per hour by the rotation of a snail cam secured to the minutes wheel.

CH681761 relates to a watch having a retrograde display of the date over 240° by means of a pinion from which some teeth are missing.

EP2010971B1 relates to a watch comprising a retrograde display of an item of time information such as the hours over an angular sector of 270°. The retrograde module comprises a cam and a rack.

EP2595006 relates to a mechanical device for a jumping hours display.

DE10200284C1 relates to a watch with a jumping hours display and a display of the minutes over a sector of 330°. An uncoupling element is provided between the minutes display wheel and the minutes drive starwheel.

CH688068 relates to a retrograde display of the seconds over an angular sector by means of a minutes pinion from which some teeth are missing and which engages with a rack.

BRIEF SUMMARY OF THE INVENTION

It is an object of the present invention to propose a retrograde display mechanism which differs from the existing solutions.

It is another object of the present invention to propose a jumping display mechanism driven by a retrograde display mechanism in a different way from the known mechanisms.

According to the invention, these objects are notably achieved by means of a mechanism according to the independent device claim.

It is another object of the invention to propose a display method which is different from the methods of the prior art.

It is another object of the invention to propose a retrograde and jumping display method which is simplified.

According to the invention, these objects are achieved by means of a watch movement mechanism which comprises a cam, a rack driven by the cam, a retrograde mobile driven by the rack and bearing a retrograde indicator to display a first item of time information, the rack and the retrograde mobile being arranged in such a way as to rotate in the same direction.

According to another aspect of the invention, the watch movement mechanism comprises a cam, a rack driven by the cam, a retrograde mobile driven by the rack and bearing a retrograde indicator to display a first item of time information, the end of the rack comprises an opening provided with an internal toothing, the retrograde mobile being able to be driven by the internal toothing.

The direction of rotation of the rack is determined by the shape and by the direction of rotation of the cam, for example a snail cam. It is desirable to provide a cam which rotates in the counterclockwise direction during usual operation of the watch; this is because this allows it to be driven directly off the hours wheel of a conventional movement, which usually rotates in the clockwise direction. The rack driven by the periphery of the cam then rotates in the clockwise direction. The mechanism claimed, which makes it possible to drive the retrograde mobile directly in the same direction as the rack, thus makes it possible to dispense with an intermediate transfer wheel, and therefore to limit the number of components and the amount of play in the geartrain.

The mechanism may have a rack the end of which comprises an opening equipped with an internal toothing, it being possible for the retrograde mobile to be driven by the internal toothing.

It is possible for just a portion of the internal opening, for example the portion on the opposite side to the cam, to be equipped with a toothing.

The rack end provided with two branches separated by an opening is more rigid than a single-branch conventional end, making it possible to limit the play with respect to the retrograde mobile.

This solution also has the advantage of offering a more pleasing look due to the unusual shape of the rack in a retrograde display mechanism. The fact that the rack, the retrograde mobile and the retrograde indicator all rotate in the same direction adds to the unusual character of the retrograde display device according to the invention.

According to one embodiment, the watch movement mechanism may comprise a cam, a rack driven by the cam, a retrograde mobile driven by the rack and bearing a retrograde indicator for displaying a first item of time information, the rack and the retrograde mobile preferably being arranged in such a way as to rotate in the same direction, a jumping display ring for displaying a second item of time information, the jumping display ring comprising an internal toothing, the rack comprising a drive member collaborating with the internal toothing in order to drive the jumping display ring in rotation in a jumping way.

According to one embodiment, the cam may be driven by the watch movement by means of a friction center-wheel or intermediate transfer wheel.

This solution also offers the advantage of being novel and of differing from existing solutions.

In one preferred embodiment, the watch movement comprises a correction mechanism making it possible to correct the retrograde mobile in both directions; and a drive member that can be actuated by the correction mechanism and is in mesh with the asymmetric internal toothing so that the corrections of the retrograde mobile in the clockwise direction are transmitted to the hours ring, whereas the corrections in the counterclockwise direction are not transmitted to the hours ring.

By virtue of the two-directional correction of the retrograde display, it is possible to correct its position without completing a full revolution. The time can thus be set more quickly.

For example, in the case of a retrograde minutes display, it is possible to correct the position of this indicator in both directions. If the watch movement gains by a few minutes, it can therefore be corrected back without having to make an almost full revolution forwards and without affecting the position of the hours indicator.

This embodiment thus offers the advantage over the prior art of allowing a simple and quick correction of the retrograde indicator, for example of the minutes indicator.

The corrections of the retrograde indicator in the clockwise direction are transmitted to the jumping hours ring. In the case of a retrograde minutes indicator, this for example makes it possible to correct the jumping hours indicator in the clockwise direction, with a jump by one hour each time the minutes indicator moves on from 59 to 00. This correction of the jumping hours ring can be achieved very simply by using the jumping hour drive mechanism used during normal watch operation.

The corrections of the retrograde minutes indicator in the counterclockwise direction (in order to retard it) are, by contrast, preferably not transmitted to the jumping hours ring. This is because the usual jumping hours drive mechanisms do not usually allow a jump to be made in the counterclockwise direction; they are designed only to move the jumping hours ring on in the clockwise direction, under the action of the geartrain. In other words, the correction is not driven by the crown in the counterclockwise direction. For example, jumping hours drive mechanisms often comprise a cam with a jump, for example a snail cam, which jump can be crossed only in one direction. By avoiding transmitting the corrections in the counterclockwise direction to the jumping hours ring, the need to modify the drive mechanism of this ring is thus avoided.

By thus choosing a correction that is unlimited in the clockwise direction, but limited in terms of correcting the minutes in the counterclockwise direction, a movement is obtained that is practical, easy to manipulate, and at the same time considerably simplifies construction in relation to a movement that allows correction that is unlimited in both directions which affords merely a small improvement in convenience for a considerably greater complexity.

This construction thus makes it possible to produce a correction mechanism that is simple, allowing a great number of corrections to be made with very few manipulations of the crown and without needing to modify the jumping hours ring drive mechanism.

In one embodiment, a correction blocking mechanism is provided to prevent the retrograde mobile from being corrected in the counterclockwise direction within a range around the jump of this disk, and to allow same in all the other positions of this disk outside of that range. For example, if the retrograde mobile displays minutes, the mechanism may prevent correction in the counterclockwise direction when the retrograde minutes indicator is indicating a value in a range including the minute 60. That makes it possible to avoid the risk of the jumping hours indicator accidentally moving as a result of a correction in the counterclockwise direction of the minutes disk in this range.

This correction blocking mechanism may be connected to a cam feeler, which may be on the rack, and block the rotation of the snail cam in one of the two directions of rotation when this snail cam is situated near to the position of the feeler jump.

The internal toothing connected to the jumping display ring may comprise a plurality of teeth with asymmetric flanks, such that the drive member of the rack may butt against one flank of a tooth of the internal toothing, to drive the jumping display ring when the rack is rotating in the counterclockwise direction, and slides along another flank of a tooth of the internal toothing, or so as not to be in contact with the internal toothing when the rack is rotating in the clockwise direction.

The drive member that drives the rack may be mounted on the rack by means of an axis allowing it to pivot.

The mechanism may comprise a spring mounted on said rack and exert a force to press the drive member against said internal toothing.

The drive member may be a tooth or a finger.

In one embodiment, the first item of time information may be the current hour, the second item of time information being able to be the current minute.

According to the invention, the method for displaying items of time information by means of a watch movement mechanism described hereinabove may comprise the steps in which:

the movement drives said cam, the cam drives the rack, the rack drives the retrograde mobile and the indicator, the rack drives the jumping current-hour display ring, the rack, the retrograde mobile and the indicator rotating in the same direction.

The method allows the jumping display ring to be driven in rotation in jumping manner by a regulating member mounted on the rack.

According to the invention, the clockwise rotation of said rack may drive the clockwise rotation of the retrograde mobile and the counterclockwise rotation of said jumping display ring in order to display the current hour.

According to the invention, when the cam rotates in the counterclockwise direction and drives the rotation of said rack in the clockwise direction, said rack, by rotating in the clockwise direction, may drive the rotation in the same direction of the retrograde mobile, of the indicator and of the finger, and said finger may move along one flank of the internal toothing connected to the jumping display ring without causing said ring to rotate.

When the first end of the rack drops from the peak of said cam, the second end of the rack is driven in rotation in the counterclockwise direction near-instantaneously, causing the near-instantaneous rotation in the same direction of the retrograde mobile, of the tooth, of the indicator and of the jumping display ring that bears the hours.

The mechanism may be made up of a watch movement, of a complication intended to collaborate with a movement, of an additional module, etc.

The mechanism described may also be used for the jumping display of information other than the hour, and/or for the retrograde display of information other than the minutes.

BRIEF DESCRIPTION OF THE FIGURES

Exemplary embodiments of the invention are indicated in the description which is illustrated by the attached figures in which.

For the sake of clarity, the figures do not depict the movement that drives the mechanism according to the invention.

EXAMPLE(S) OF EMBODIMENT(S) OF THE INVENTION

Figure 1:
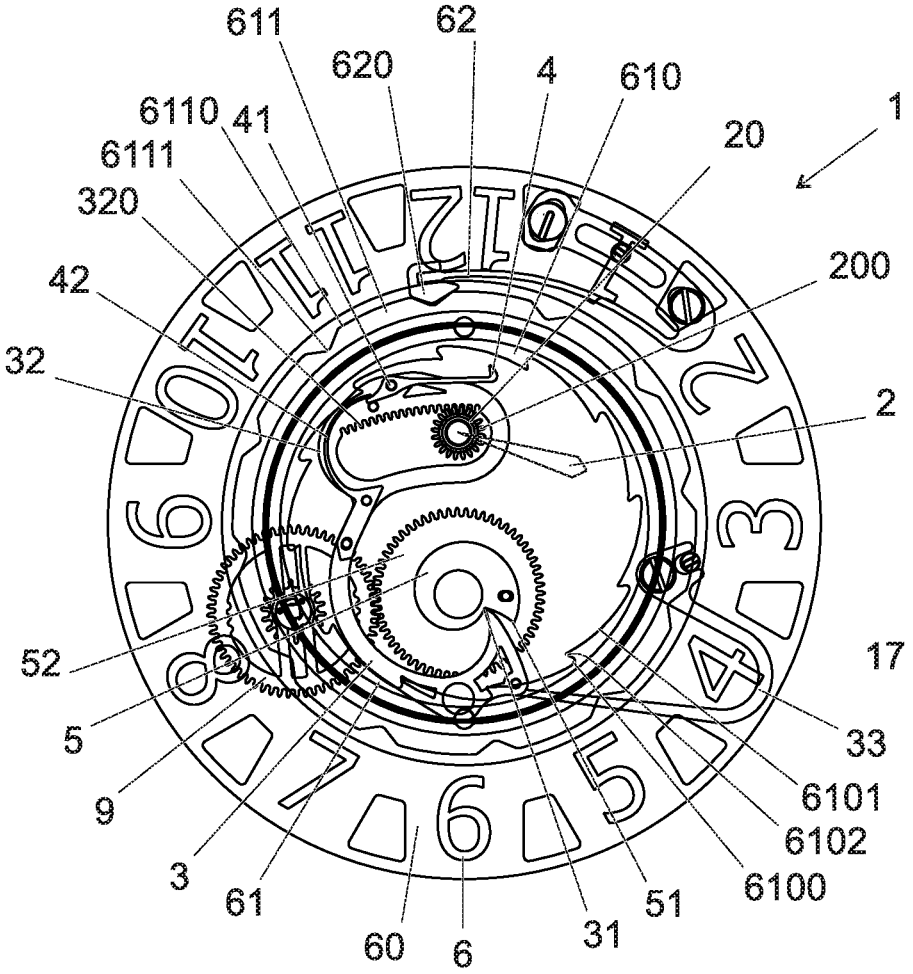
FIG. 1 illustrates a view from above of the key components of the mechanism according to the invention.

FIG. 1 illustrates an example of a retrograde mechanism 1 according to the invention. It comprises a retrograde indicator 2 depicted in the form of a minute hand in this embodiment. The retrograde minutes indicator 2 is mounted on the axis of the retrograde mobile 20. The retrograde mobile 20 comprises an external toothing 200.

The rack 3 has a first end 31 pressing against the periphery of the snail cam 5 by virtue of a rack spring 33. The second end 32 of the rack 3 comprises an oblong opening equipped with an internal toothing 320. The rack 3 pivots under the action of the snail cam from the pivot point. During this pivoting, the internal toothing 320 of the second end of the rack 32 engages with the external toothing 200 of the retrograde mobile 20 so that the retrograde indicator 2 borne by the retrograde mobile 20 turns in the same direction as the second end of the rack 32. The movement of the rack is transmitted to a drive member, here consisting of a tooth 4 articulated to the second end of the rack 32 by means of the axis 41. A return spring 42 applies a return force to the tooth 4 in order to press it against the toothing 610.

The first end of the rack 31 follows the rotation of the snail cam 5 borne by a driving release wheel 52. This driving release wheel 52 is driven by a wheel of the geartrain in such a way that the minutes indicator 2 travels over the minutes scale 11 (FIGS. 2 to 11) in 60 minutes (or 60 minutes minus the return time).

In this embodiment, the mechanism 1 comprises a jumping display ring 60 bearing the hour indications 6 allowing the current hour to be displayed in a window 10 (FIGS. 2 to 11).

The jumping display ring 60 is driven by the smaller-diameter drive ring 61. In an alternative form which has not been illustrated, it is also conceivable for the hour indications 6 to be positioned directly on the drive ring 61 or on a ring of the same diameter.

The drive ring 61 comprises an internal toothing 610 with a plurality of teeth around the entire internal periphery. The spacing between the teeth is even and there is no missing tooth. The teeth have two asymmetric flanks 6100 and 6101. The first flank 6100 is almost parallel to the diameter of the drive ring 61 and allows the drive ring 61 to be driven by means of the drive member (tooth) 4. The tooth 4 acts as a drive member for the jumping hours display. The second flank 6101 is curved; the mean inclination forms an angle of less than 30° with the tangent to the drive ring 61 so that when the tooth 4 is in contact with the second flank 6101, it can slide along this second flank 6101 without driving same, and without driving the drive ring 61 either.

The drive ring 61 further comprises an external toothing 611 exhibiting teeth 6110 the tips of which are concentric with the drive ring 61, the hollow 6111 between each of the teeth 6110 being designed to accept the end 620 of a positioning jumper 62.

Figure 2:
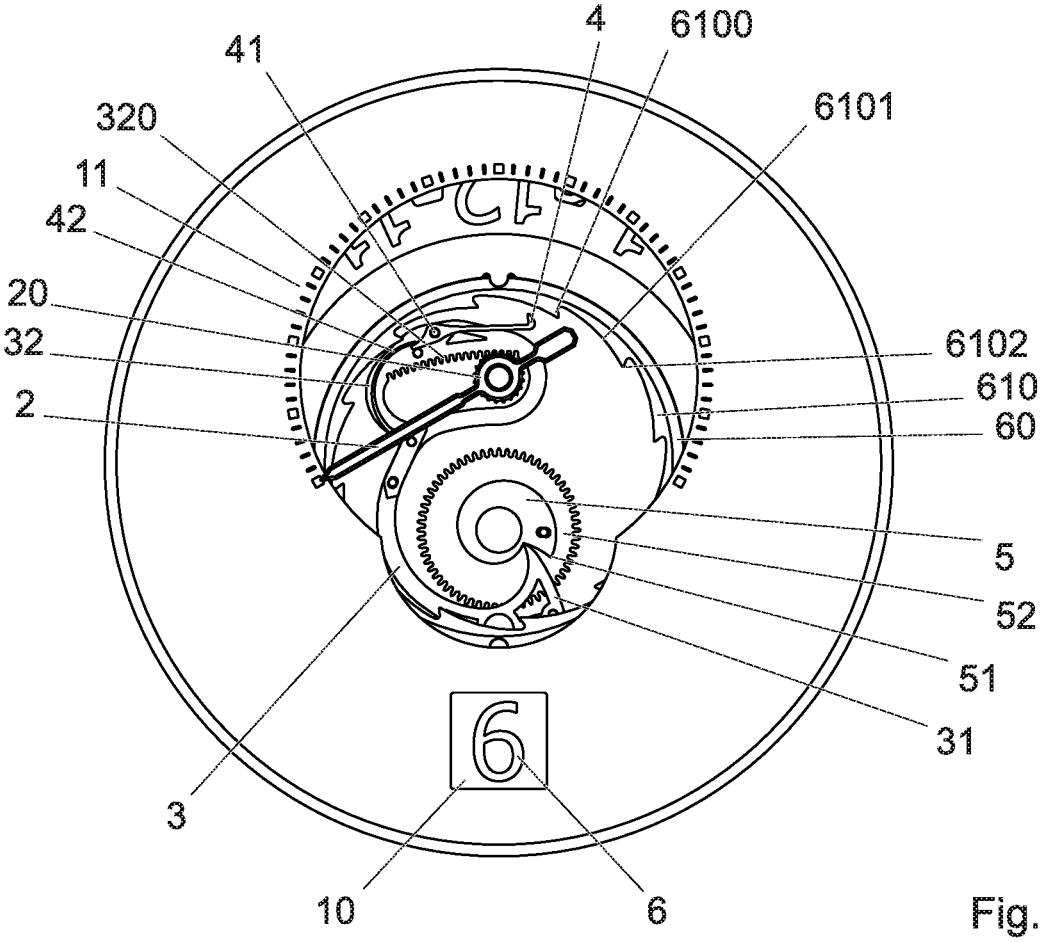
FIG. 2 illustrates a view from above of the key components of the mechanism according to the invention at minute 0.

The jumper 62 thus collaborates with the external toothing 611 in order to center the hour indications in the window 10 (FIG. 2). The end 620 of this jumper 62 opposes the movement of the drive ring 61 by engaging in the hollow 6111 between the teeth 6110 of the external toothing of the drive ring 61. The stiffness of the jumper 62 is chosen such that the jumper 62 holds the drive ring 61 in place when it is not being driven by the tooth 4 and so as to allow the end of the jumper 620 to disengage from the hollow 6111 of the external toothing 611 connected to the jumping display ring 60 under the action of the tooth 4 and by virtue of a rack spring 33.

The jumper 62 has a first end (or output end) and a second end (or input end). The two ends exhibit a non-zero inclination with respect to the vertical walls of the external toothing 611 of the drive ring 61. The jumper 62 collaborates with a jumper spring 63.

In another embodiment, only the first end of the jumper has a non-zero inclination in relation to the hollows of the external toothing of the drive ring 61; the second end is therefore appreciably parallel to the edges of these hollows when the jumper thus modified is engaged in the hollow. This particular shape of jumper allows clockwise rotation of the drive ring 61 to be blocked. In other words, the second end of the jumper is configured in such a way as to block clockwise rotation of the drive ring 61 and thus avoid a display error in the event of an impact for example.

The operation of the mechanism during normal moving-on of the retrograde display 5, namely as the minute hand 2 progressively advances from 0 to 60 minutes, will now be described with the aid of FIGS. 2 to 6.

FIG. 2 illustrates the mechanism just after the return of the retrograde minute hand 2, which therefore points toward the minute 0. In this position, the first end of the rack 31 is resting against the smallest diameter of the snail cam 5. The retrograde mobile 20 is engaged with the internal toothing 320 in the opening of the rack. In the example illustrated, the tooth 4 is not in contact with the internal toothing 610 of the jumping display ring 60.

Figure 3:
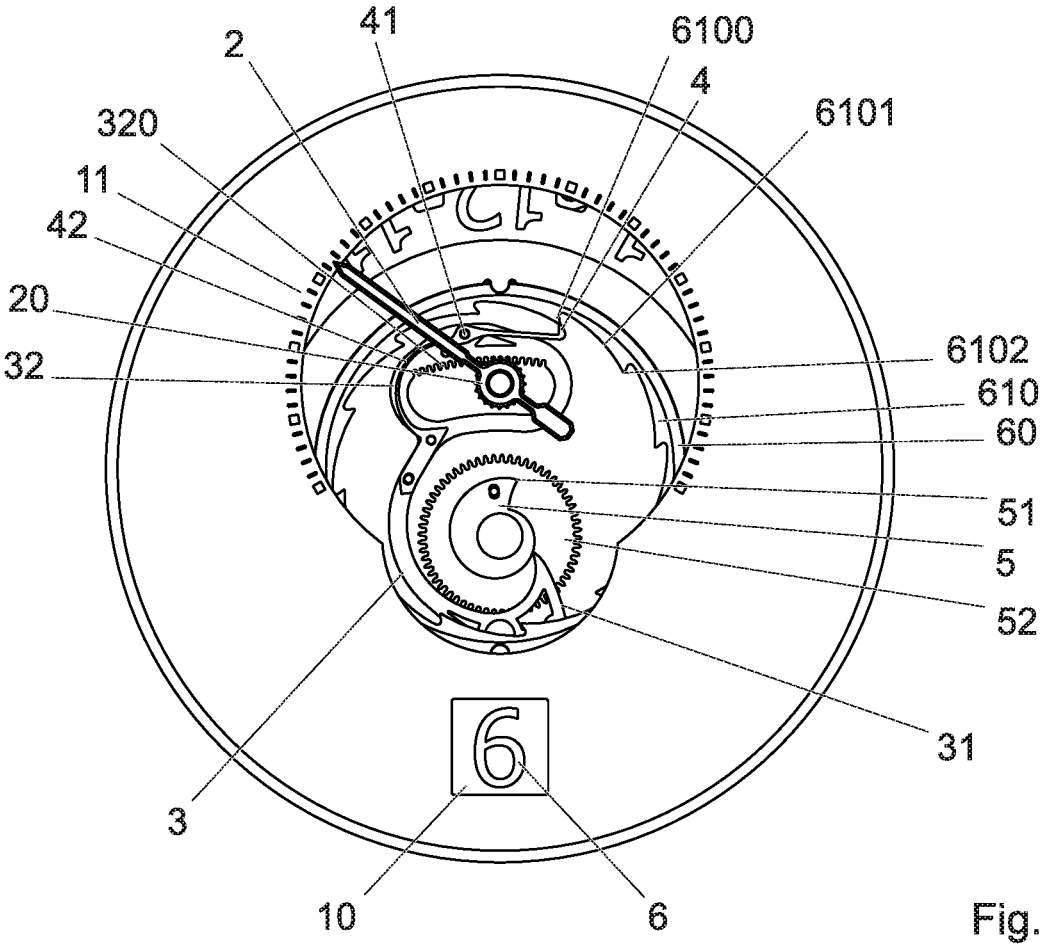
FIG. 3 illustrates a view from above of the key components of the mechanism according to the invention at minute 17.

FIG. 3 corresponds to a position of the minute hand 2 at minute 17. The snail cam 5, driven in the counterclockwise direction by the teeth of the friction disk center wheel 9 (FIG. 1), causes the second end of the rack in the figure to move in the clockwise direction to move the minute hand 2 in the clockwise direction along the minutes scale 11. The drive member 4 (tooth) presses against the tip of a tooth of the internal toothing of the drive ring 61 without having engaged with it. The drive ring 61 and the jumping display ring 60 therefore remain immobile, their position being fixed by the positioning jumper 62 which is collaborating with the hollows 6111 on the external periphery of the drive ring 61 (FIG. 1).

Figure 4:
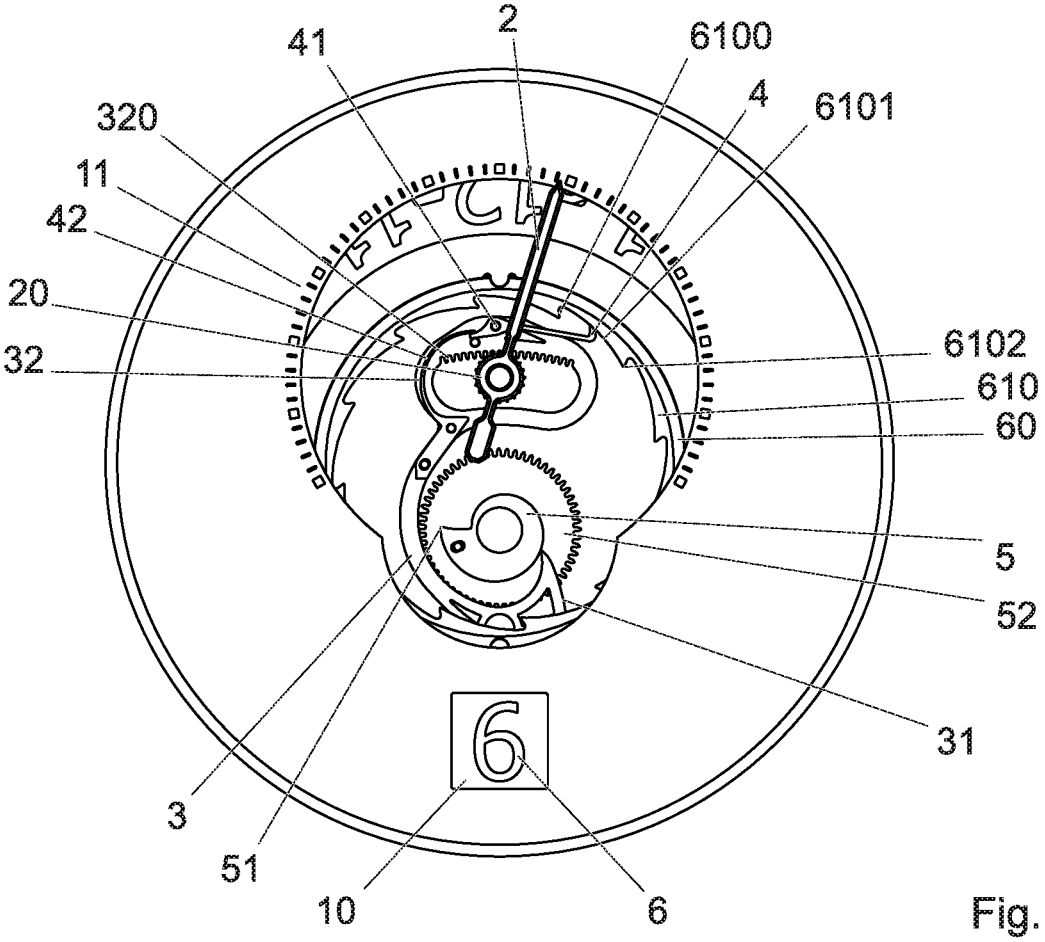
FIG. 4 illustrates a view from above of the key components of the mechanism according to the invention at minute 35.

FIG. 4 corresponds to a position of the minute hand 2 at minute 35. The retrograde mobile 20 continues to turn in the clockwise direction and the minute hand 2 to move in the clockwise direction along the minutes scale 11. The drive member 4 (tooth) comes into contact with an oblique flank 6101 of the internal toothing 610 of the drive ring 61 (FIG. 1) without having engaged with it. The drive ring 61 and the jumping display ring 60 therefore remain immobile.

Figure 5:
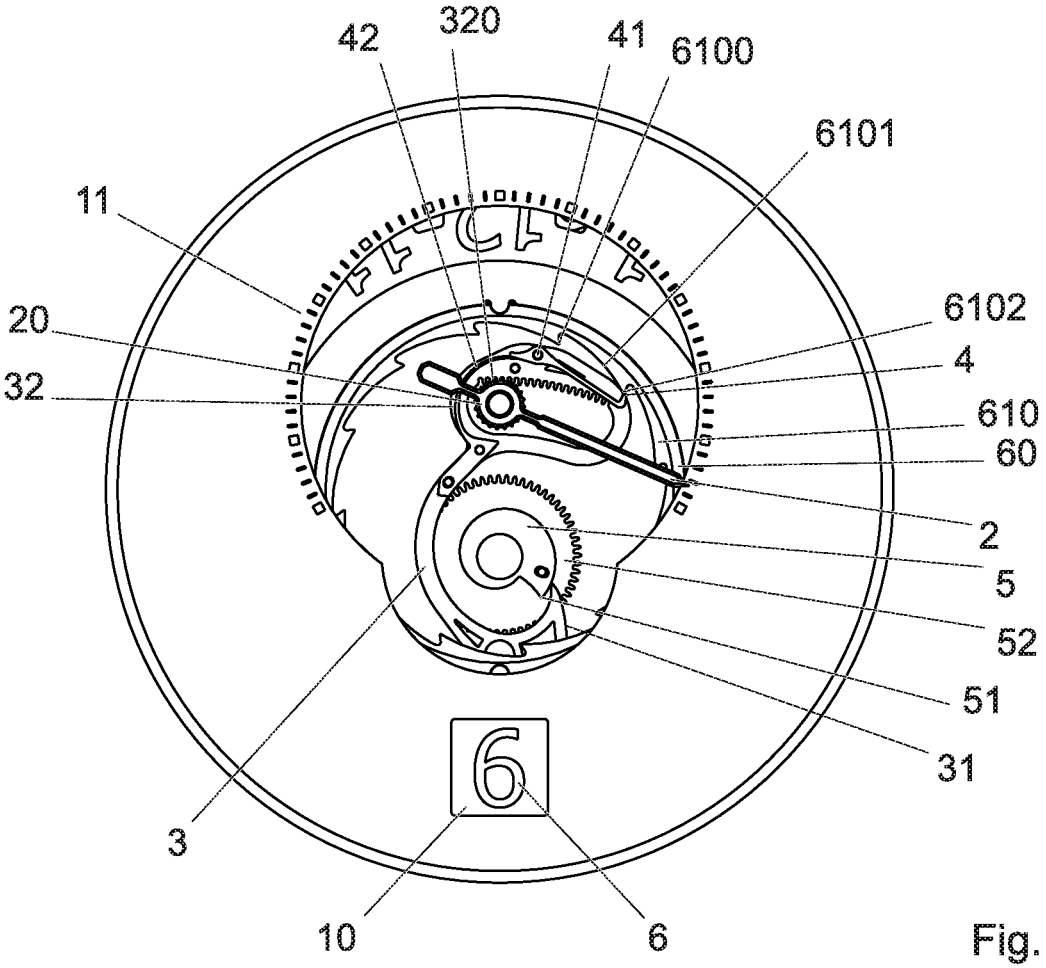
FIG. 5 illustrates a view from above of the key components of the mechanism according to the invention at minute 59.

FIG. 5 corresponds to a position of the minute hand 2 at minute 59. The first end of the rack 31 is in contact with the snail cam 5 near to the maximum-diameter portion 51 thereof. The drive member 4 (tooth) comes into contact with a tip of the internal toothing 610. During the course of the interval from 0 to 59 minutes, the tooth 4 slides along the toothing of the drive ring 61 (FIG. 1), without interfering with the position thereof.

Figure 6:
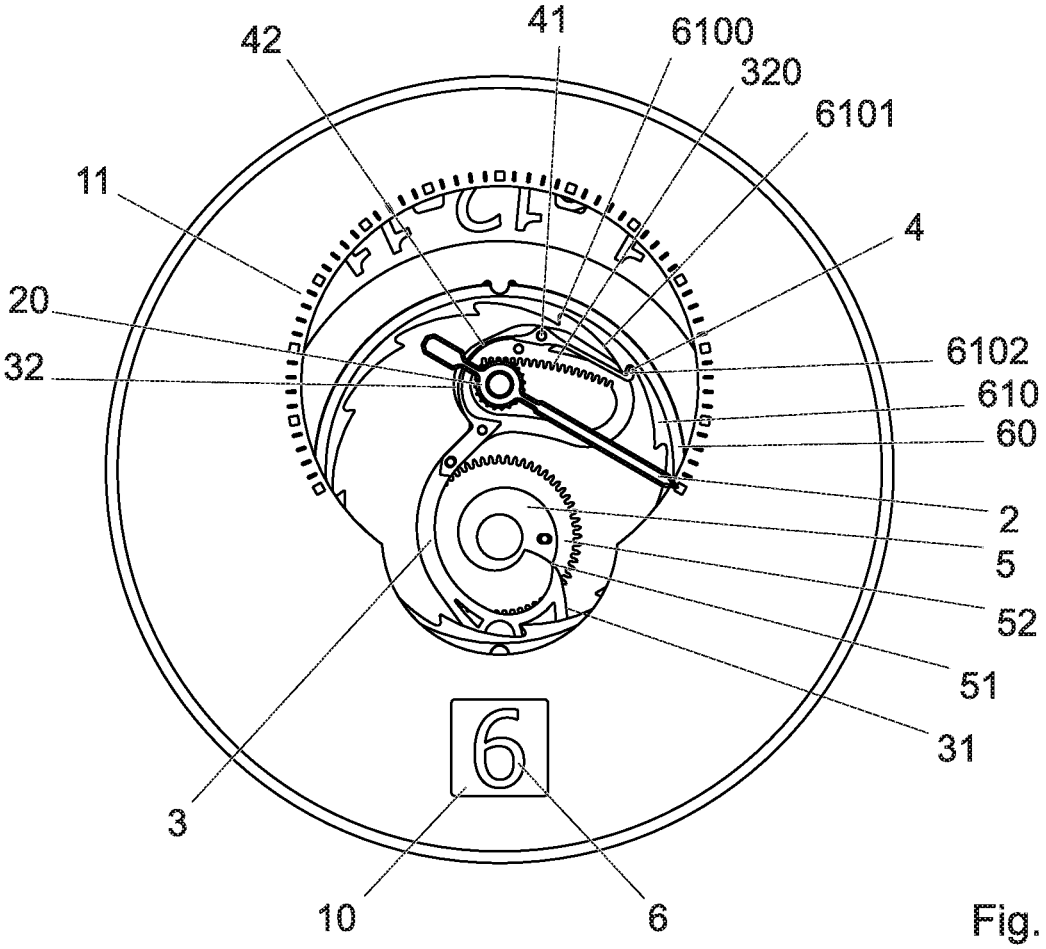
FIG. 6 illustrates a view from above of the key components of the mechanism according to the invention at minute 60.

FIG. 6 corresponds to a position of the minute hand 2 at minute 60. The first end of the rack 31 is situated at the peak of the cam 5. The drive member 4 (tooth) has moved beyond the tip of the internal toothing 610 and has engaged with a first flank 6100 of the internal toothing 610 of the drive ring 61 (FIG. 1). This ring is still held in place by the positioning jumper 62.

At minute 60, the falling of the rack 3 against the snail cam 5 simultaneously causes the near-instantaneous return of the minutes indicator 2 to 0 in the counterclockwise direction and a jump of the drive ring 61 (FIG. 1) likewise in the counterclockwise direction. This return is illustrated in FIGS. 6 to 11.

Figure 7:
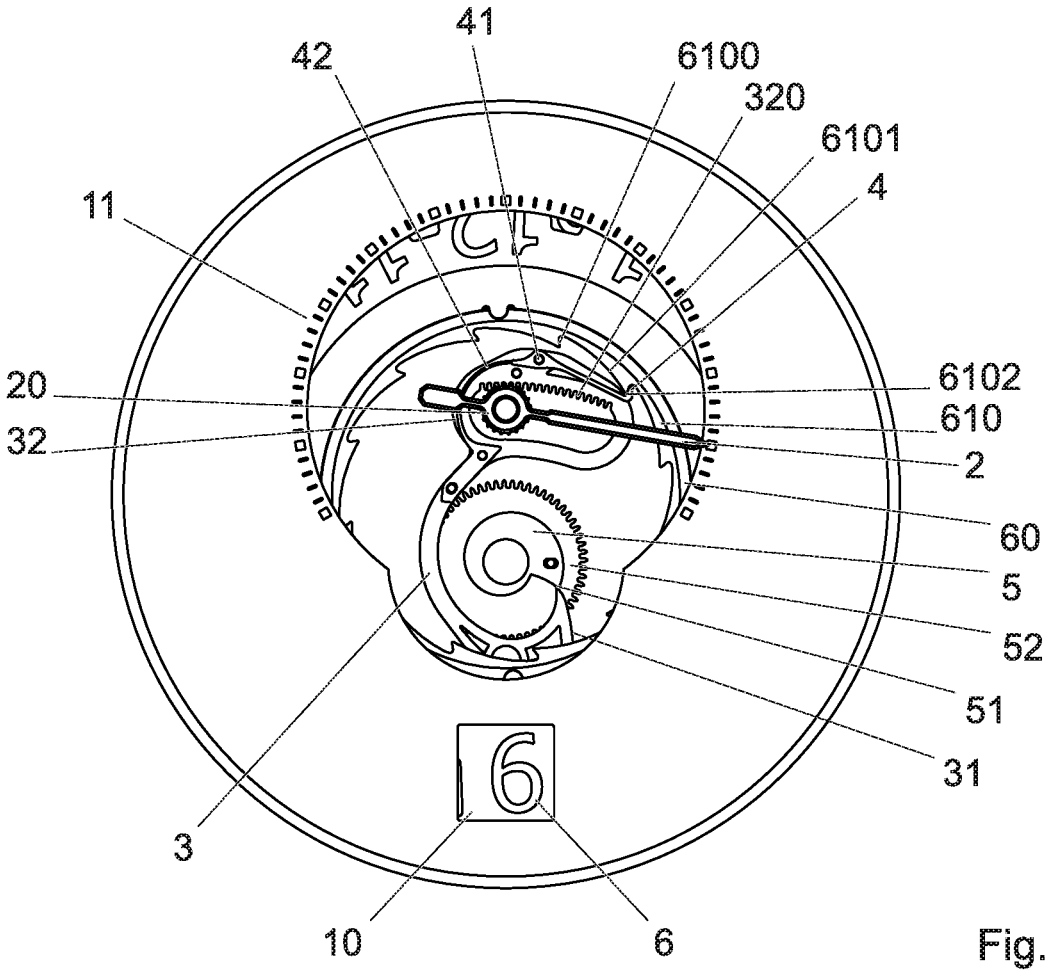
FIGS. 7 to 10 illustrate a number of views from above of the key components of the mechanism according to the invention during the jump from minute 60 to minute 0.

FIGS. 6 and 7 illustrate the start of the return to minute 0 of the retrograde indicator and the start of the jump of the jumping display. The first end of the rack 31 begins its fall from the peak of the snail cam 5. The second end of the rack 32 rotates in the counterclockwise direction causing the retrograde indicator positioned at minute 55 and the tooth 4 to rotate in the same direction. The drive ring 61 is therefore driven in the counterclockwise direction by the tooth 4, by virtue of the rack spring 33 which progressively relaxes. As it relaxes, the rack spring 33 (FIG. 1) transmits to the jumping display ring 60 (FIG. 1) enough energy to cause the end 620 of the positioning jumper 62 to leave the hollow 6111 of the external toothing 611. The movement of the jumping display ring 60 in the counterclockwise direction, causing the time to move on from h to h+1, can be seen through the window 10.

Figure 8:
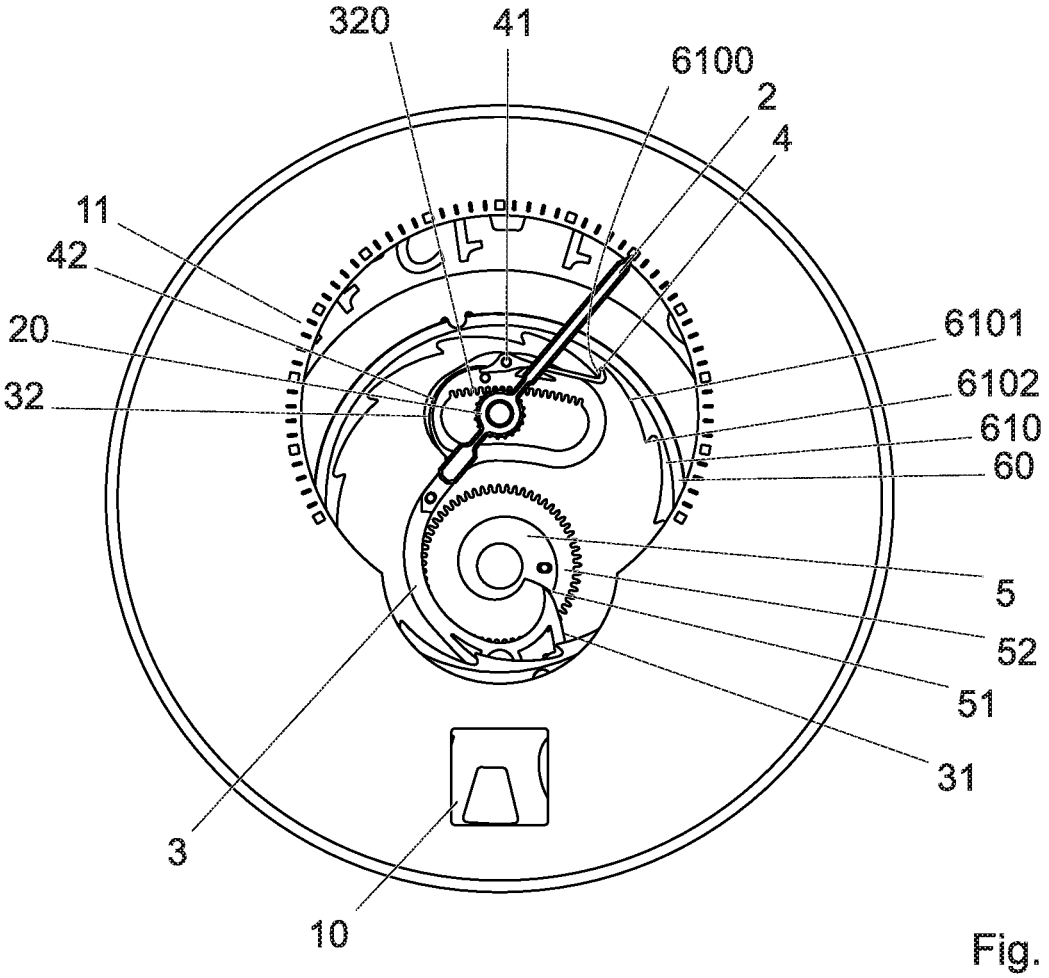
Figure 9:
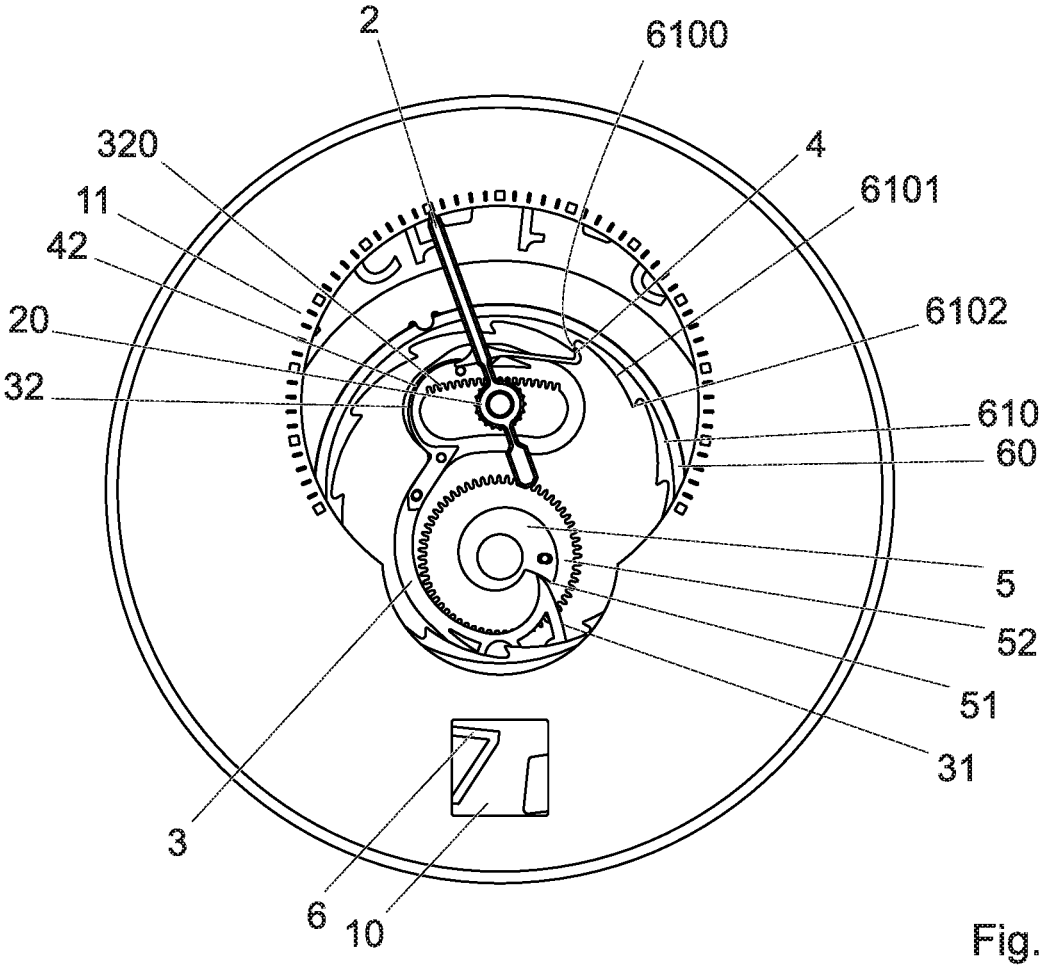

FIGS. 8 and 9 illustrate the next part of the return of the retrograde indicator. The retrograde indicator is positioned at minutes 40 and 25 respectively. The tooth 4 moves along the first flank of the internal toothing 610. The movement of the jumping display ring 60 in the counterclockwise direction, into a position between two jumping display elements 6, can be seen through the window 10. The end 620 of the positioning jumper 62 moves along the tooth 6110.

Figure 10:
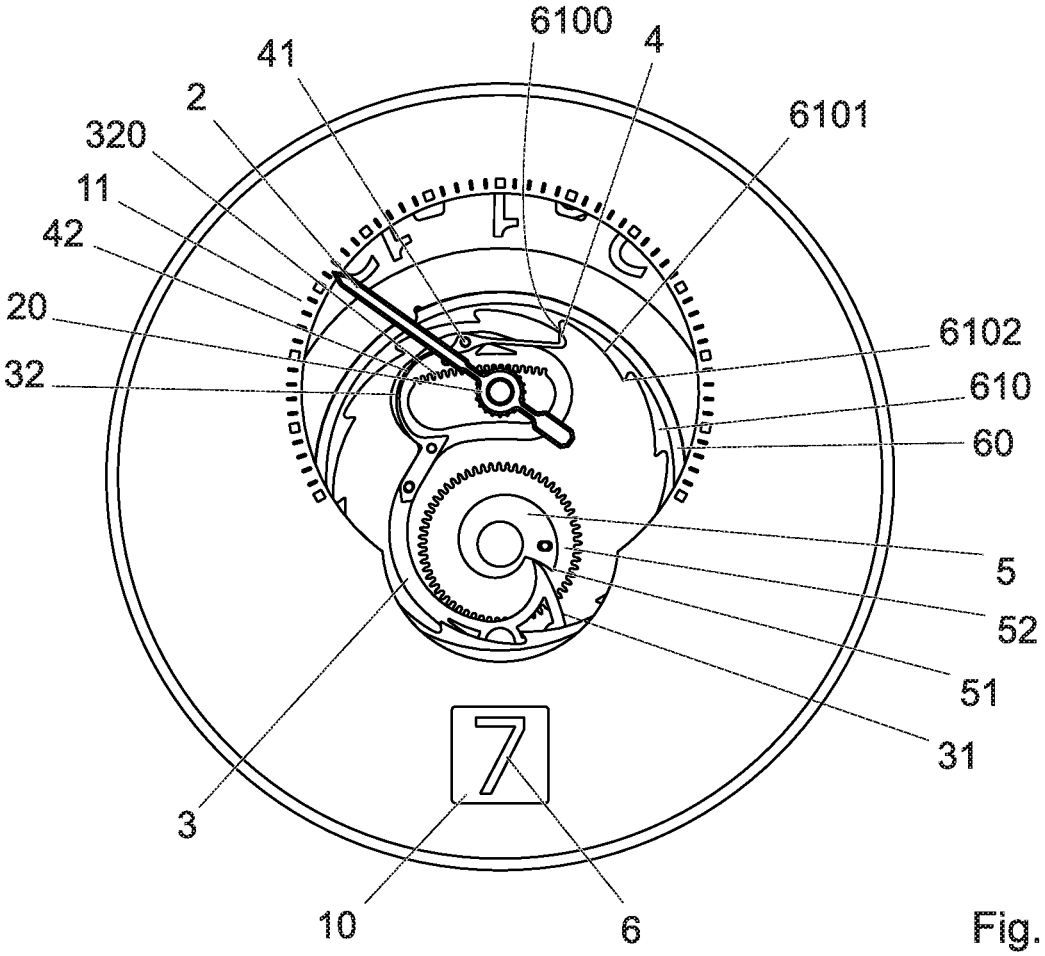

FIG. 10 illustrates the end of the return of the retrograde indicator. The retrograde indicator is positioned at minute 17 and the tooth 4 is almost at the tip of the internal toothing 610 connected with the jumping display ring 60, and will soon no longer be in mesh with the internal toothing 610. The new jumping display element 6 can be seen through the window 10. The positioning jumper 62 (not depicted) has "dropped back" into a hollow 6111 of the external toothing 611.

Figure 11:
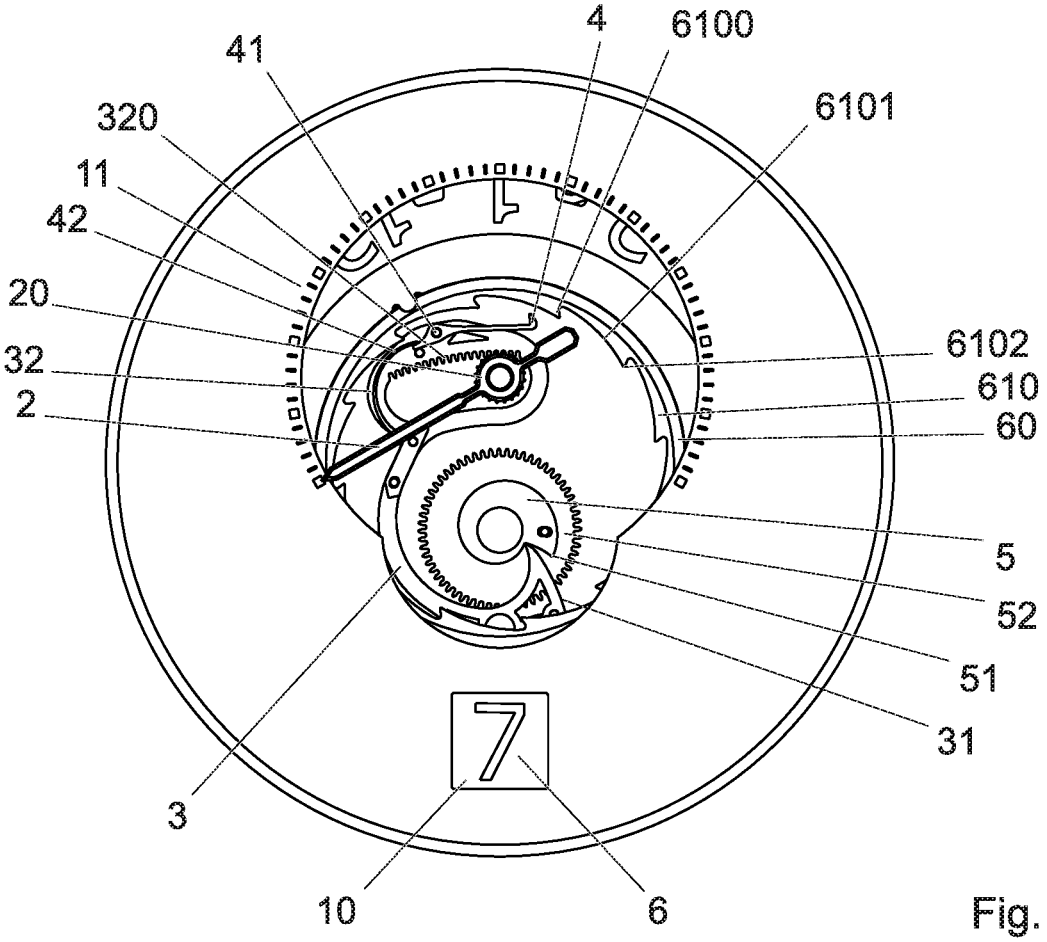
FIG. 11 illustrates a view from above of the key components of the mechanism according to the invention at minute 0.

FIG. 11 illustrates the return of the retrograde indicator to minute 0. The retrograde indicator is positioned at minute 0 and the tooth 4 is no longer in contact with the internal toothing 610 connected to the jumping display ring 60. The first end of the rack lies on the smallest-diameter part of the cam 5. The new position of the jumping display element 6 can be seen through the window 10.

In the embodiment illustrated, the minutes are displayed by the position of the retrograde indicator 2 on a minutes scale (not depicted). The minutes scale covers a circular arc of less than 360° but greater than 180°, for example of 240°. The window in which the current hour is displayed lies facing the opening portion of the scale, at the 6 o'clock position in the example illustrated.

In the embodiment illustrated by the figures described hereinabove, the mechanism allows retrograde display of the minutes and jumping display of the hours. Such a mechanism may, however, be used for the jumping display of information other than the hour, and/or for the retrograde display of information other than the minutes.

REFERENCE NUMERALS USED IN THE FIGURES

1 Mechanism for a watch movement
2 Retrograde indicator
20 Retrograde mobile
200 Toothing of mobile 20
3 Rack
31 First end of the rack
32 Second end of the rack
320 Toothing of the rack 3
33 Rack spring
4 Drive member/tooth

41 Axis
42 Spring
5 Cam
51 Peak of the cam
52 Release drive wheel
6 Jumping display element
60 Jumping display ring, for example hours ring.
61 Drive ring connected to jumping display ring
610 Internal toothing of drive ring 61
6100 First flank of toothing 610
6101 Second flank of toothing 610
6102 Tip of toothing 610
611 External toothing of drive ring 61
6110 Tooth of toothing 611
6111 Hollow of toothing 611
62 Jumper for positioning the drive ring 61
620 End of positioning jumper 62
9 Center wheel friction disk/retrograde minutes intermediate transfer gear
10 Jumping hours window
11 Minutes scale

The invention claimed is:

1. A mechanism for a watch movement comprising:
a cam;
a rack driven by said cam;
a retrograde mobile driven by said rack and bearing a retrograde indicator for displaying a first item of time information, the rack and the retrograde mobile being arranged in such a way as to rotate in the same direction, wherein the mechanism further comprises:
a jumping display ring to display a second item of time information, said jumping display ring comprising an internal toothing, and
said rack comprising a drive member collaborating, with said internal toothing to drive said jumping display ring in rotation in a jumping way.

2. The mechanism as claimed in claim 1, one end of said rack comprising an opening fitted with an internal toothing, said retrograde mobile being driven by said internal toothing.

3. The mechanism as claimed in claim 1, in which said internal toothing comprises a plurality of teeth with asymmetric flanks, said rack drive member being arranged in such a way as to butt against one flank of a tooth of the internal toothing and to drive the jumping display ring when the rack is rotating in the counterclockwise direction, and to slide along another flank of a tooth of the internal toothing, or so as to not be in contact with the internal toothing when the rack is rotating in the clockwise direction.

4. The mechanism as claimed in claim 1, said drive member being mounted on the rack by means of an axis allowing it to pivot.

5. The mechanism as claimed in claim 4, comprising a spring mounted on said rack and applying force to press said drive member against said internal toothing.

6. The mechanism as claimed in claim 1, in which said first item of time information is the current hour, and said second item of time information is the current minute.

7. A method for displaying items of time information by means of a watch movement as claimed in claim 6, comprising the following steps:
the movement drives said cam,
said cam drives said rack,
said rack drives said retrograde mobile and the retrograde indicator,
said rack drives said jumping display ring in order to display the current hour,
wherein said rack, said retrograde mobile and the indicator rotate in the same direction.

8. The method as claimed in claim 7, in which said jumping display ring is driven in rotation in a jumping way by a drive member mounted on said rack.

9. The method as claimed in claim 7, in which the clockwise rotation of said rack drives the clockwise rotation of the retrograde mobile and the counterclockwise rotation of said jumping display ring which displays the current hour.

10. The method as claimed in claim 7, in which,
when said cam rotates in the counterclockwise direction and drives the rotation of said rack in the clockwise direction,
said rack, by rotating in the clockwise direction, drives the rotation in the same direction of the retrograde mobile, of the indicator and of the drive member, and
said drive member moves along a flank of the internal toothing connected with the jumping display ring without driving the rotation of said jumping display ring.

11. The method as claimed in claim 7, in which, when said first end of the rack reaches the peak of said cam, the drive member is butting against a flank of the internal toothing connected with the jumping display ring.

12. The method as claimed in claim 7, in which, when the first end of the rack drops from the peak of said cam, the second end of the rack is driven in rotation in the counterclockwise direction near-instantaneously, causing the near-instantaneous rotation in the same direction of the retrograde mobile, of the indicator, of the drive member and of the jumping display ring.

* * * * *